United States Patent [19]

Appelt

[11] 4,326,144

[45] Apr. 20, 1982

[54] ROTATING ANODE X-RAY TUBE

[75] Inventor: Guenter Appelt, Erlangen, Fed. Rep. of Germany

[73] Assignee: Siemens Aktiengesellschaft, Berlin & Munich, Fed. Rep. of Germany

[21] Appl. No.: 124,128

[22] Filed: Feb. 25, 1980

[30] Foreign Application Priority Data

Apr. 3, 1979 [DE] Fed. Rep. of Germany ..... 2913336

[51] Int. Cl.[3] ..... H01J 35/10

[52] U.S. Cl. ..... 313/60

[58] Field of Search ..... 313/60

[56] References Cited

U.S. PATENT DOCUMENTS

| | | | |
|---|---|---|---|
| 2,280,886 | 4/1942 | Brace | 313/60 |
| 2,335,253 | 11/1943 | Atlee | 313/60 |
| 2,570,770 | 10/1951 | Combée | 313/60 |
| 2,885,583 | 5/1959 | Zunick et al. | 313/60 |
| 3,699,373 | 10/1972 | Holland et al. | 313/60 |
| 3,710,162 | 1/1973 | Bougle | 313/60 |

FOREIGN PATENT DOCUMENTS

| | | | |
|---|---|---|---|
| 1056286 | 4/1959 | Fed. Rep. of Germany | 313/60 |
| 2058152 | 5/1972 | Fed. Rep. of Germany | 313/60 |
| 2724732 | 12/1978 | Fed. Rep. of Germany | 313/60 |
| 1019130 | 10/1952 | France | 313/60 |
| 1443103 | 5/1966 | France | 313/60 |
| 1247316 | 9/1971 | United Kingdom . | |

*Primary Examiner*—Palmer C. Demeo

*Attorney, Agent, or Firm*—Hill, Van Santen, Steadman, Chiara & Simpson

[57] ABSTRACT

In an exemplary embodiment, the shaft for the rotating anode is supported by ball bearings in a tubular support-mounting extending into the envelope of the tube. Particularly in the case of rotating anodes, which rotate very rapidly (e.g. 300 Hz), it is disadvantageous that rubbed-off residue falls out of the bearings, on the one hand, and that lubricant leaves the bearings, on the other hand. For the improvement of the operating properties and a permanent lubrication, and the improvement of the high voltage strength by avoidance of loose particles in the tube envelope, the disclosure provides an arrangement of covers on the bearings and possibly one or more radial barriers rotating with the shaft between the stationary covering parts. A rotating anode x-ray tube with a bearing protected in accordance with the disclosure is particularly suited for use in x-ray tubes with very rapidly rotating anode plates.

2 Claims, 4 Drawing Figures

ROTATING ANODE X-RAY TUBE

BACKGROUND OF THE INVENTION

The invention relates to a rotating anode x-ray tube wherein the anode shaft is supported by ball bearings which contain a lubricant, and a cover is provided for the purpose of keeping the lubricant in the bearing. Rotating anodes of this type are, for example, known from the British Patent No. 1,247,316.

In the known x-ray tubes great demands are made of the bearings because they run in high vacuum under temperature variation stresses. Therefore, in the case of bearings which must run in this manner for a long period of time without relubrication, in the construction known according to the abovecited reference, friction surfaces of a material capable of being lubricated have been manufactured. However, the danger here is that the lubricant forms a rubbed (or worn)-off residue which falls out of the bearing. Other lubricants introduced in the bearing in a known fashion, such as molybdenum sulfide and silver, etc., can likewise escape from the bearing causing an impairment of the lubrication of the latter.

In an x-ray tube according to the U.S. Pat. No. 2,280,886, in an embodiment, the ball bearings are provided with sealing parts which have the purpose of providing chambers for accommodating molybdenum sulfide as lubricant. However, bearings of this type with an encased (enclosed) ball race (or running) space have not proven successful in x-ray technology because, due to the large radial clearance necessary in order to absorb the temperature expansion, a gap must remain which is so wide that lubricant particles can escape and enter the tube-space.

Another x-ray tube, known according to the U.S. Pat. No. 2,570,770, has a bearing in proximity of the anode to which there is pre- (or series-) connected, on the side facing the plate, a receptacle with soft material as lubricant. The receptacle is to be mounted on the shaft. However, such a design has not proven successful because in the case of x-ray tubes the disadvantage arises that the receptacle co-rotates and lubricant particles can be spun (or centrifuged) into the tube space.

SUMMARY OF THE INVENTION

Accordingly, the object underlying the invention resides in providing measures, in the case of a rotating anode x-ray tube with lubricated ball bearings, to keep the lubricant on the bearing and to avoid the falling-out of rubbed-off residues, on the other hand. In accordance with the invention, this object is achieved by the features disclosed in claim 1.

Through the utilizaton of a ball bearing in which the inner races of the balls are associated with the rotating axis, and the exterior races are associated with a tubular support-mounting, loose particles occurring during rotation are spun (or centrifuged) outwardly, so that cover metal sheets, which are annular and connected with the tubular support-mounting at their outer margin, prevent rubbed-off residue and lubricant present in loose form from leaving the bearing. The lubricant cover configuration for the bearing proximate to the anode plate can have the form of a metal sheet which is arranged on the side of such proximate bearing which is adjacent the anode plate. The gap remaining between the interior edge of this metal cover sheet and the shaft is expediently kept on the order of magnitude of the radial slack (or clearance), in order to allow loose particles as little opportunity as possible for escaping from the bearing into the tube; i.e., on such an order of magnitude which results from the radial clearance necessary for the running of the bearing, the tolerances to be allowed for the manufacture, and the center deviation remaining during the centering. In the case of a 10 mm-thick shaft consisting of hardenable steel this is an air gap +0.2 to +0.265 mm. Toward the other side of the proximate bearing a contamination of the tube interior space is avoided anyway if the bearings are arranged in a sealed tubular support separated from the interior space of the x-ray tube.

Through an additional metal sheet on the side of the proximate bearing not facing the anode plate, lubricant can be fixed on the bearing into which it is filled. Correspondingly, longer lasting lubrication can also be obtained on the anode-remote bearing.

In particular, on the side of the proximate bearing facing the anode plate, it has proven to be favorable to provide a bearing covering in the form of a grooved ring including an outer axially extended annulus adjacent the exterior bearing race, a radially extending web leading inwardly toward the shaft, and a reversely extending flange disposed in encircling relation to the shaft. In this manner, a lubricant barrier with a collecting (or trapping) space or recess is obtained in which loose particles can be retained. Also in the case of this arrangement, the clearance between the interior side of the flange and the exterior side of the shaft is expediently on the order of magnitude of the required bearing slack (or clearance). In particular on account of the reversely axially extending flange arranged in this manner an extended (or elongated) narrow path along the shaft and hence an improved retention of loose particles can be achieved.

It has also proven to be favorable to provide lubricant barrier configurations both in the form of a cover sheet and in the form of a recessed ring. This is very particularly advantageous if, in addition, the shaft is provided with a thickening constructed in a step-wise fashion, whereby the step lies between the sheet and the end of the reversely extending flange of the recessed ring. The height of the step should be at least 0.7 mm and, on account of the axial play (which may be a maximum of 0.3 mm with a radial clearance of thirty microns, 30 $\mu$) should not exceed an order of magnitude of one millimeter (1 mm). In utilizing a sheet whose inner diameter is so selected that the distance from the adjoining exterior surface of the shaft, which is before the step, corresponds at least approximately to the bearing clearance, this leads to the result that passing-through particles reach the step and are spun (or centrifuged) by the latter into the collector recess of the ring on account of the rotation of the shaft. Thus, the direct travel (or migration) path along the shaft is cut off for the particles. Between the step and the collector recess of the ring additional steps and coverings, designed in a corresponding fashion, can be arranged in order to increase the effect.

Further advantages and details of the invention shall be explained in the following on the basis of the exemplary embodiments illustrated in the Figures on the accompanying drawing sheet; and other objects, features and advantages will be apparent from this detailed disclosure and from the appended claims.

DETAILED DESCRIPTION

Figure 1:
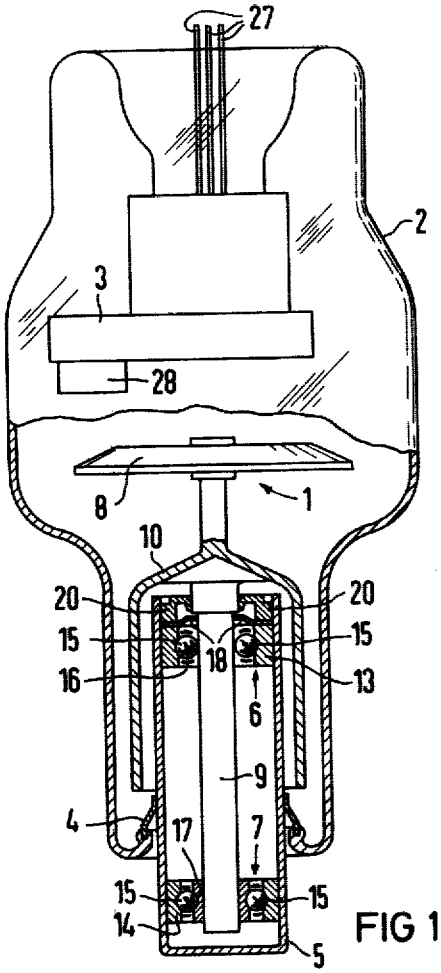
In FIG. 1 an x-ray tube, partially in section, is illustrated provided with an inventively improved mounting for the rotating anode thereof.

In FIG. 1, reference numeral 1 designates a rotating anode which is housed in a glass vacuum envelope 2. Moreover, the envelope 2 additionally contains, in a manner known per se, a cathode 3. The anode, with the envelope 2, is sealed onto a tubular part 5, the so-called anode stem, via a collar 4. Between the anode 1 and the support-mounting 5, ball bearings 6 and 7 are disposed. The rotating anode 1 itself consists of an anode plate 8 which is fixedly secured at the upper end of a shaft 9. Also disposed on the shaft is a rotor 10 which may be driven via a stator to be exteriorly joined to the envelope 2, and not illustrated, to effect rotation of the anode plate 8.

The two ball bearings 6 and 7 are disposed within the rotor 10 and, with their exterior races 13 and 14, are mounted on the interior side of the tubular support-mounting 5. The rolling bearing is provided in a manner known per se, by balls 15 which are supported in a ball cage 16. The balls 15 of the bearing 6, in proximity to the anode plate, thus run directly on the shaft 9, whereas for the balls 15 of the bearing 7, which is remote from the anode plate, a race 17 with a race (or running) channel is provided on the shaft 9 in order to prevent longitudinal displacement of the shaft.

Figure 2:
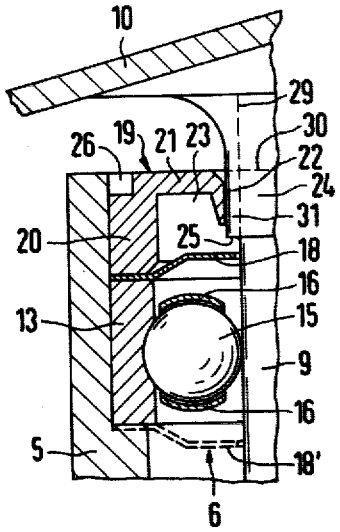
In FIG. 2 a partial sectional view of the bearing which is in proximity to the anode plate is illustrated.

At the plate-side end of the proximate bearing 6 a cover metal sheet 18 is provided which is fixedly clamped at its exterior edge between the race 13 and the channel-shaped ring 19, FIG. 2, by being disposed between the lower axial end of the outer annulus 20 of the ring 19 and the bearing race 13. The channel-shaped ring 19, moreover, consists of a part 21, extending radially toward the shaft 9 at the other axial end of the annular part 20, and of a radially inner flange 22 extending axially in surrounding relation to the shaft. In this manner, the annular recess 23 is obtained, which is formed by the interior borders of the annulus part 20, the radial part 21, and the reversely extending flange 22, which recess 23 is well-suited for collecting loose particles which overcome the barrier formed by sheet 18 and pass through the gap between the interior edge of the sheet 18 and the shaft 9. This gap, just like that between the flange 22 and the thickened part 24 of the shaft 9, may correspond in size to the necessary bearing slack (or clearance).

A further improvement in the seal is obtained by a step 25 which is disposed between the thickened part 24 and the normal part of the shaft 9. The latter is so arranged that it is disposed between the upper surface of the covering 18 and the lower edge of the flange 22 (as viewing in FIG. 2). In this manner, particles, which overcome the barrier provided by sheet 18 by passing through the gap at its inner edge, are centrifuged, or flung toward the exterior at the step or shoulder 25 and into the recess 23 of the channel-shaped part 19, on account of the rotational movement of the shaft 9, and said particles are retained therein. The entire arrangement is wedged peened-over by means of a closing device at 26 such that a fixation of the parts 18 and 19 together with the bearing 6 is achieved. Possibly a covering 18', indicated in broken lines at the underside of the bearing 6, can yet additionally be fixedly clamped in order to retain lubricant on the bearing.

In a similar manner as bearing 6, bearing 7 can also be provided with covering sheets corresponding to coverings 18, 18', FIG. 2. For the latter, in particular, only coverings corresponding to 18 and 18' are to be provided, because from this bearing 7 no loose particles can reach the interior space of the envelope 2. Through such a covering of both bearings 6 and 7 it has been shown that it is possible to achieve an increase in life by 300%, with permanently reduced running (or background) noise, in particular, for very rapidly running anodes.

Figure 3:
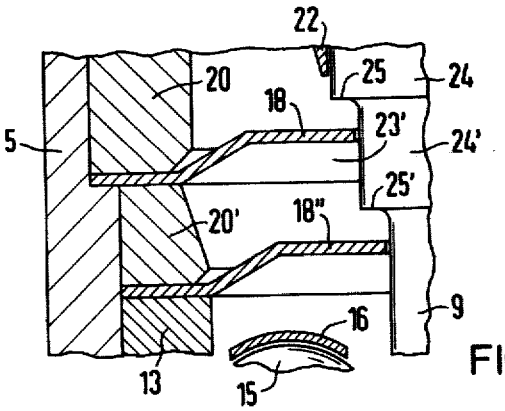
In FIG. 3 a design with increased effectiveness is illustrated.

The effect can be increased by a multiple layout of the combination of sheet 18 and step 25. In FIG. 3, such a layout is indicated in which, through insertion of a sheet 18'' and a step 25' between the sheet 18 and the end of the bearing 6, the combination is doubled with the creation of an additional collecting space 23'. For the purpose of support-mounting a spacing ring 20' is inserted, and an additionally thickened part 24' results on the shaft 9.

The steps 25 and 25' can, as illustrated in FIG. 3, be obtained through processing of the shaft 9. However, as indicated by broken lines 29 and 30 in FIG. 2, they can also be manufactured by means of a ring 31, FIG. 4, which is mounted on the shaft 9 such that it forms the thickening 24 and its one end face represents the step 25. The ring can, for example, be soldered-on or welded-on, etc.

Figure 4:
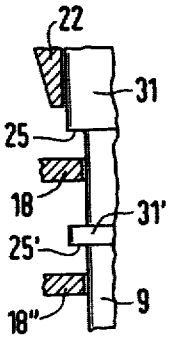
In FIG. 4 a modified solution is illustrated.

In FIG. 4 this design is illustrated in a partial section, whereby also the step 25' is designed as a ring 31'. Expediently the same material will be used for shaft 9 and rings 31, 31', or at least materials having very similar coefficients of expansion will be used.

Otherwise, the tube can be put in operation in a conventional manner by connecting corresponding voltages between the leads 27 and the tubular support-mounting 5 functioning as the anode stem. To this end, electrons issuing from the support structure 28 of a thermionic cathode arrive on the focal spot path of the anode plate 8 and there produce x-rays.

It will be apparent that many modifications and variations may be effected without departing from the scope of the novel concepts and teachings of the present invention.

I claim as my invention:

1. A rotating anode x-ray tube comprising an x-ray tube envelope (2), a rotating anode plate (8) in the envelope, a rotatable shaft (9) supporting said anode plate for rotating, a ball bearing assembly for rotatably mounting said shaft (9) comprising a remote bearing (7) remote from the anode plate having an interior race (17) on the exterior side of the shaft (9), and a proximate bearing (6) in proximity to the anode plate (8) having an exterior race (13) fixedly arranged relative to the envelope (2), and bearing cover means for keeping the lubricant in the bearing, said bearing cover means comprising an annular bearing cover configuration (18, 19) fixedly connected with said exterior race (13) and extending radially inwardly at the side of the proximate bearing toward said anode plate (8) to provide in conjunction with the centrifugal force on the lubricant during operation, a barrier to migration of lubricant in an axial direction toward said anode plate, characterized in that a step (25) at a thickening of the shaft (9) in directin of the plate (8), is additionally provided, and characterized in that the annular bearing cover configuration comprises a sheet metal ring (18) extending from the side of said exterior race (13) which is toward said anode plate (8), and extending radially inwardly to provide an inner edge encircling said shaft on the side of said step (25) remote from said anode plate, said annular bearing cover configuration further comprising a channel shaped annular part (19) including collecton means (23) on the side of said step toward the anode plate.

2. A rotating anode x-ray tube according to claim 1, characterized in that, between the collector means (23) of the annular part (19) and the proximate bearing (6), additional steps (25') and metal sheets (18'') are arranged as barriers to migration of lubricant to the interior of the envelope.

* * * * *